United States Patent [19]

Salmi

[11] Patent Number: 4,852,690

[45] Date of Patent: Aug. 1, 1989

[54] AERIAL LADDER TOWER WITH PRETENSIONED TRUSS MEMBERS

[75] Inventor: James A. Salmi, Lititz, Pa.

[73] Assignee: Simon Ladder Towers, Inc., Ephrata, Pa.

[21] Appl. No.: 280,417

[22] Filed: Dec. 5, 1988

[51] Int. Cl.[4] ..... E06C 7/10

[52] U.S. Cl. ..... 182/219; 182/67; 182/106

[58] Field of Search ..... 182/217, 218, 219, 67, 182/106

[56] References Cited

U.S. PATENT DOCUMENTS

| | | | |
|---|---|---|---|
| 146,029 | 11/1873 | Smith | 182/219 |
| 240,757 | 7/1881 | Owen | 182/21 |
| 745,750 | 12/1903 | Betzner | 182/219 |
| 785,901 | 10/1905 | Mallory . | |
| 922,847 | 5/1909 | Boyer | 182/219 |
| 1,167,988 | 9/1916 | Faulkner . | |
| 1,836,516 | 12/1931 | Weiser | 182/219 |
| 1,887,546 | 11/1932 | Cowell | 182/219 |
| 1,943,724 | 1/1934 | Cowell | 182/219 |
| 2,229,987 | 1/1941 | Phelps . | |
| 2,238,665 | 4/1941 | Troche . | |
| 2,248,794 | 7/1941 | Troche . | |
| 2,542,923 | 10/1951 | Hallen . | |
| 3,199,627 | 8/1965 | Wagner et al. | 182/163 |
| 3,533,203 | 10/1970 | Fischer et al. | 52/223 |

*Primary Examiner*—Reinaldo P. Machado
*Attorney, Agent, or Firm*—Michael R. Swartz; John R. Flanagan

[57] ABSTRACT

In a ladder tower having multiple telescoping sections, each section includes a pair of longitudinally extending, laterally spaced apart truss members and a plurality of longitudinally spaced ladder rungs interconnecting the truss members. Each truss member includes an upper elongated hand rail, a lower elongated rung rail being spaced below and lying in a common plane with the upper hand rail, and a plurality of braces extending between and interconnecting the upper hand rail and lower rung rail of each truss member. The ladder rungs of each section extend between and interconnect the rung rails of the truss members thereof. Pretensioning structure is connected to the hand rail of each truss member so as to load the hand rail in compression and the rung rail in tension and thereby substantially offset the dead load of each section due to its weight and permit an increase in the live load capacity of each section. Further, the hand rail of each truss member of each ladder tower section is hollow. The pretensioning structure being connected to the hand rail of each truss member includes a pretensioned flexible member in the form of a cable disposed in the hollow hand rail of the truss member and anchored at its opposite ends to the hollow hand rail at locations within and spaced from opposite ends of the hand rail.

13 Claims, 5 Drawing Sheets

FIG. 11
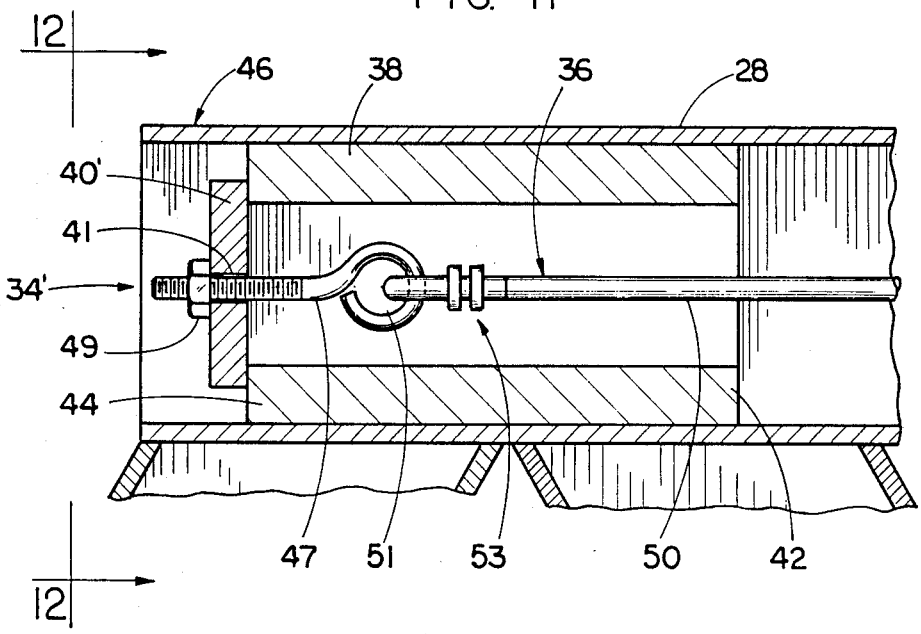
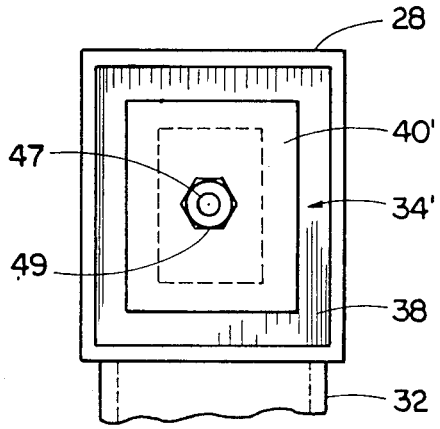
FIG. 12

AERIAL LADDER TOWER WITH PRETENSIONED TRUSS MEMBERS

BACKGROUND OF THE INVENTION

1. Field of the Invention

The present invention generally relates to aerial devices such as ladders, towers, elevating platforms, and other such extension structures, commonly referred to herein as an aerial ladder tower or ladder tower, and more particularly, is concerned with an aerial ladder tower with pretensioned truss members which increases its live load capacity.

2. Description of the Prior Art

Aerial ladder towers are commercially available with multiple telescoping sections which extend in cantilever fashion from a support vehicle to considerable combined lengths. For instance, Simon Ladder Towers Incorporated (LTI) of Ephrata, Pennsylvania manufactures and sells aerial ladder tower models which extend to approximately 55, 75, 85 and 100 feet. Each ladder tower typically includes three or more telescoping sections with each section composed of two laterally spaced apart truss members interconnected by longitudinally spaced ladder rungs.

As it is telescoped out from a fully retracted position to a fully extended position, the aerial ladder tower is expected to deflect along its longitudinal extent due to its own weight ("dead load") and that of any persons standing on it ("live load"), with maximum deflection being at its free distal end where a work platform is commonly located. For example, in one LTI aerial ladder tower model adapted to extend to approximately 100 feet and designed to support an approximately 800 pound live load, a deflection of up to 18 inches at its distal end is to be expected due to its dead load alone. The ladder tower is also anticipated to deflect up to another 12 inches due to the application of the maximum live load of 800 pounds which results in a total maximum deflection of 30 inches for the combined dead load and maximum live load.

Although the aerial ladder tower is designed to be and in fact is structurally sound and safe even with such a large deflection, a problem is created by the deflection which is really one of perception of users. While not justified in their fears, users perceive that since the ladder tower has such a large deflection it must be unsafe. As a consequence, it would be desirable to provide reassurance to users by finding a way to appreciably reduce the deflection.

Generally speaking, there have been two techniques used in the prior art to strengthen single section ladders and multi-section extension ladders against bending and deflection -- by reinforcing the structures and by prestressing them. Representative of the prior art are the structures disclosed in U.S. Pat. Nos. to Smith (146,029), Mallory (785,901), Faulkner (1,167,988), Phelps (2,229,987), Troche (2,238,665 and 2,248,794) and Fischer et al (3,533,203). While many of the above-cited structures as well as others in the prior art probably operate reasonably well and generally achieve their objective under the limited range of operating conditions for which they were designed, none appears to suggest an appropriate solution to the aforementioned perception problem related to aerial ladder tower deflection.

Consequently, a need exists for an approach which will reduce aerial ladder tower deflection to a point where unjustified user concerns with safety because of such deflection will be substantially reduced, if not practically eliminated.

SUMMARY OF THE INVENTION

The present invention provides an aerial ladder tower with pretensioned truss members designed to satisfy the aforementioned needs. The aerial ladder tower of the present invention employs pretensioning of each truss member by placement of a pretensioned wire rope cable in an upper hollow hand rail thereof and anchoring the cable at its opposite ends to the opposite ends of the hand rail. With the truss members pretensioned at their respective upper hand rails, then when the ladder tower sections are extended, their dead load and the pretensioning load on them offset one another resulting in a relatively straight extended ladder tower with substantially reduced deflection. The application of a live load to the ladder tower will still produce the same deflection as before, but this is considered to be acceptable since the total deflection has been substantially reduced. Because of the placement of the pretensioning loads in the upper hand rails of the truss members, not only is dead load-induced deflection offset but also live load capacity is increased.

Accordingly, the present invention is directed to an improvement in a ladder tower section. The section has a pair of longitudinally extending, laterally spaced apart truss members and a plurality of longitudinally spaced ladder rungs interconnecting the truss members. Each of the truss members includes an upper hand rail, a lower rung rail being spaced below the upper hand rail, and reinforcing means extending between and interconnecting the upper hand rail and lower rung rail. The ladder rungs of the section extend between and interconnect the rung rails of the respective truss members thereof. The improvement comprises means attached to each of the truss members so as to preload the hand rail thereof in compression and the rung rail thereof in tension such that an increase in the live load capacity of the section is achieved. Also, the preload means attached to each truss member is connected to the hand rail thereof so as to load the hand rail in compression and load the rung rail thereof in tension and thereby substantially offset the dead load of the section due to its weight.

More particularly, the hand rail of each truss member is hollow and the preload means being attached to each truss member includes a pretensioned flexible member, such as a cable, disposed in the hollow hand rail of each truss member. The pretensioned flexible member is anchored at its opposite ends to the hollow hand rail at locations within and spaced from opposite ends thereof. The preload means being attached to each truss member also includes a hollow sleeve having inner and outer opposite ends and being disposed and rigidly affixed within each opposite end of the hollow hand rail at the locations therein spaced from opposite ends of the hand rail. Further, a connector is coupled on each opposite end of the flexible member and positioned outside of and rigidly affixed to the outer end of each hollow sleeve with each opposite end portion of the flexible member extending through each sleeve. The flexible member has an element, such as a hook or the like, defined on each opposite end thereof being disposed outwardly of the connector. Each hook element is useful in pretensioning the flexible member during deployment of the same within the hollow hand rail.

Also, the present invention is set forth in a ladder tower having multiple telescoping sections wherein each section includes a pair of longitudinally extending, laterally spaced apart truss members and a plurality of longitudinally spaced ladder rungs interconnecting the truss members. The present invention is directed to the combination comprising each of the truss members of each of the ladder tower sections as follows: (a) an upper elongated hand rail; (b) a lower elongated rung rail being spaced below the upper hand rail, with the ladder rungs of each section extending between and interconnecting the rung rails of the truss members thereof; (c) a plurality of braces extending between and interconnecting the upper hand rail and lower rung rail of each truss member; and (d) pretensioning means connected to the hand rail of each truss member so as to load the hand rail thereof in compression and the rung rail thereof in tension and thereby substantially offset the dead load of each section due to its weight and permit an increase in the live load capacity of each section.

More particularly, the hand rail of each truss member of each ladder tower section is hollow. Further, the pretensioning means being connected to the hand rail of each truss member includes a pretensioned flexible member in the form of a cable disposed in the hollow hand rail of each truss member and anchored at its opposite ends to the hollow hand rail at locations within and spaced from opposite ends thereof.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIGS. 11 and 12 are views similar to the views of FIGS. 6 and 8 and show an alternative arrangement for anchoring the opposite ends of the cable within the opposite ends of the hollow hand rails.

DETAILED DESCRIPTION OF THE INVENTION

Figure 1:
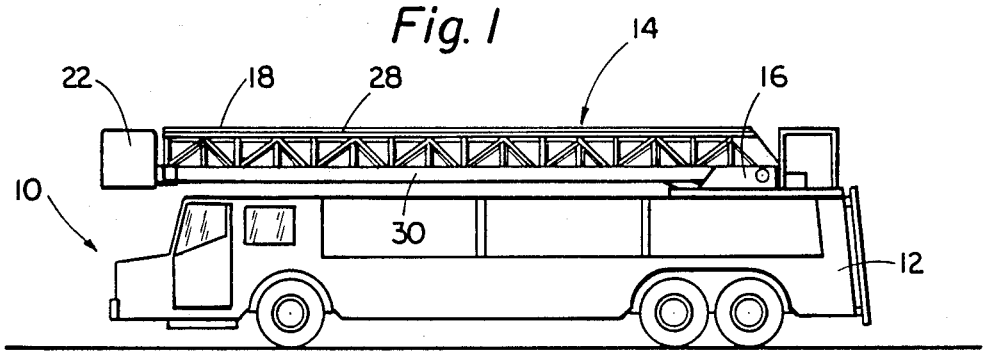
FIG. 1 is a side elevational view of a fire truck having mounted thereon a ladder tower constructed in accordance with the principles of the present invention with the multiple sections of the ladder tower being shown in a retracted and stored position in which it is transported.

In the following description, like reference characters designate like or corresponding parts throughout the several views of the drawings. Also in the following description, it is to be understood that such terms as "forward", "left", "upwardly", etc., are words of convenience and are not to be construed as limiting terms.

Figure 10:
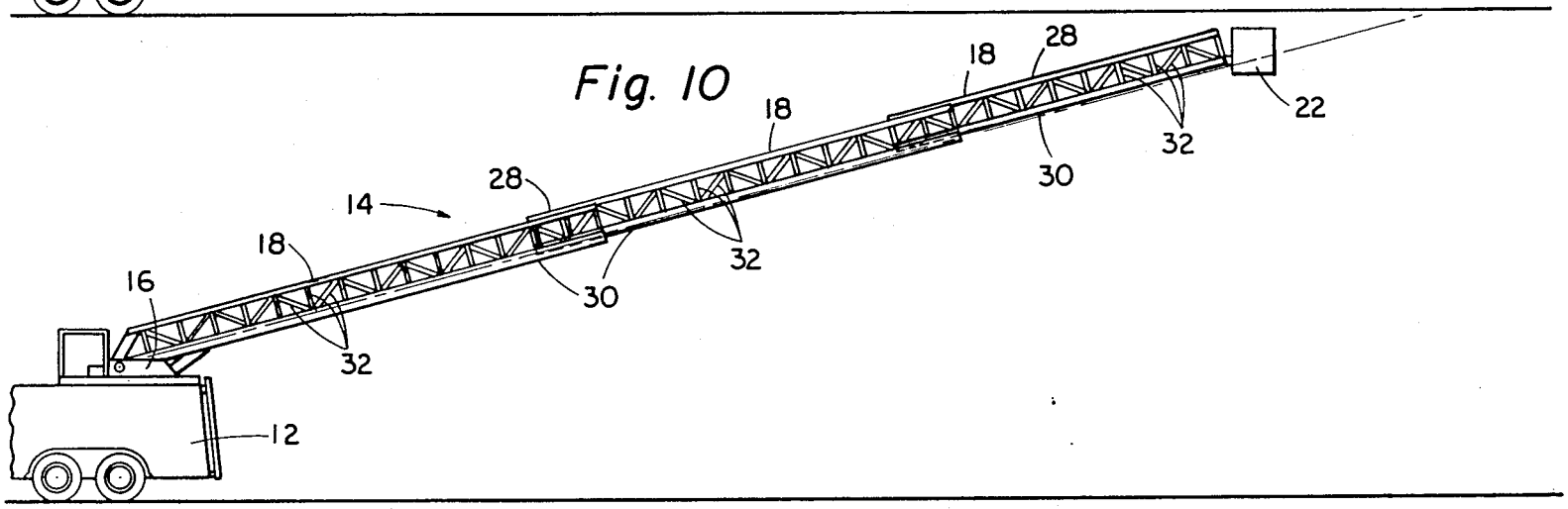
FIG. 10 is a side elevational view of the ladder tower constructed in accordance with the present invention and being shown in an extended position wherein its dead load is substantially offset by the pretensioning structure such that there is substantially no deflection of the ladder tower due to its dead load.

Referring now to the drawings, and particularly to FIG. 1, there is shown a fire truck 10 having mounted thereon at the rear of its chassis 12 a multi-section ladder tower 14 being constructed in accordance with the principles of the present invention. As is conventional, the ladder tower 14 is attached by a platform or turret 16 to the rear of the chassis 12 for rotation with the turret about a generally vertical axis through 360 degrees relative to the chassis. The ladder tower 14 also includes multiple nestible sections 18, for instance three in number, which can telescope with respect to another between a retracted and stored position, as shown in FIG. 1, in which the sections 18 of the ladder tower 14 are nested for transport and an extended position, as shown in FIG. 10, in which the ladder tower sections are deployed for use. Additionally, the ladder tower 14 can pivot vertically relative to the turret 16 about a generally horizontal axis between a horizontal position, shown in FIG. 1, and any one of a number of inclined positions, such as shown in FIG. 10.

Figure 2:
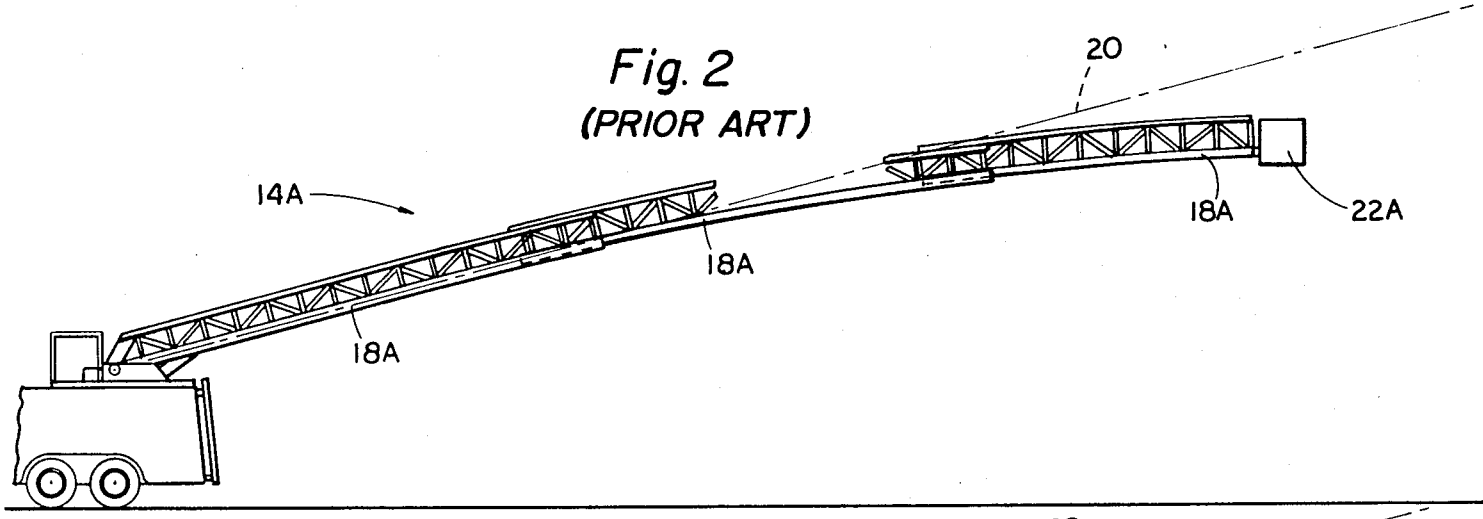
Fig. 2 (PRIOR ART)
FIG. 2 is a side elevational view of a prior art ladder tower being shown in an extended position in which it is used and with deflection of the ladder tower due to its dead load being depicted in exaggerated form.

In absence of being constructed in accordance with the principles of the present invention which will be described hereinafter, the sections 18A of the prior art ladder tower 14A of FIG. 2 when telescoped out to their extended position will deflect below an imaginary staight line 20, as seen in exaggerated form in FIG. 2, with the working platform 22A on the distal end of the ladder tower 14A being displaced the greatest amount from the line 20. The deflection of the ladder tower 14A, which is depicted in FIG. 2, is due primarily to its dead load and secondarily to the looseness of fit of the sections 18A together. When persons are positioned on the extended ladder tower 14A even more deflection is experienced due to the live load.

Figure 5:
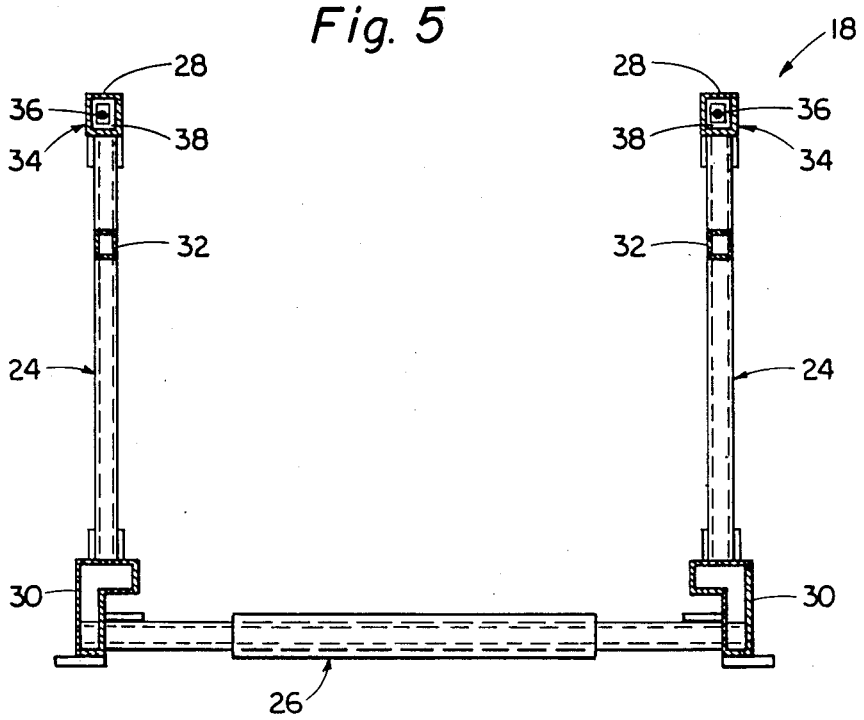
FIG. 5 is a cross-sectional view of the middle ladder tower section taken along line 5—5 of FIG. 3.
Figures 3, 4, 9:
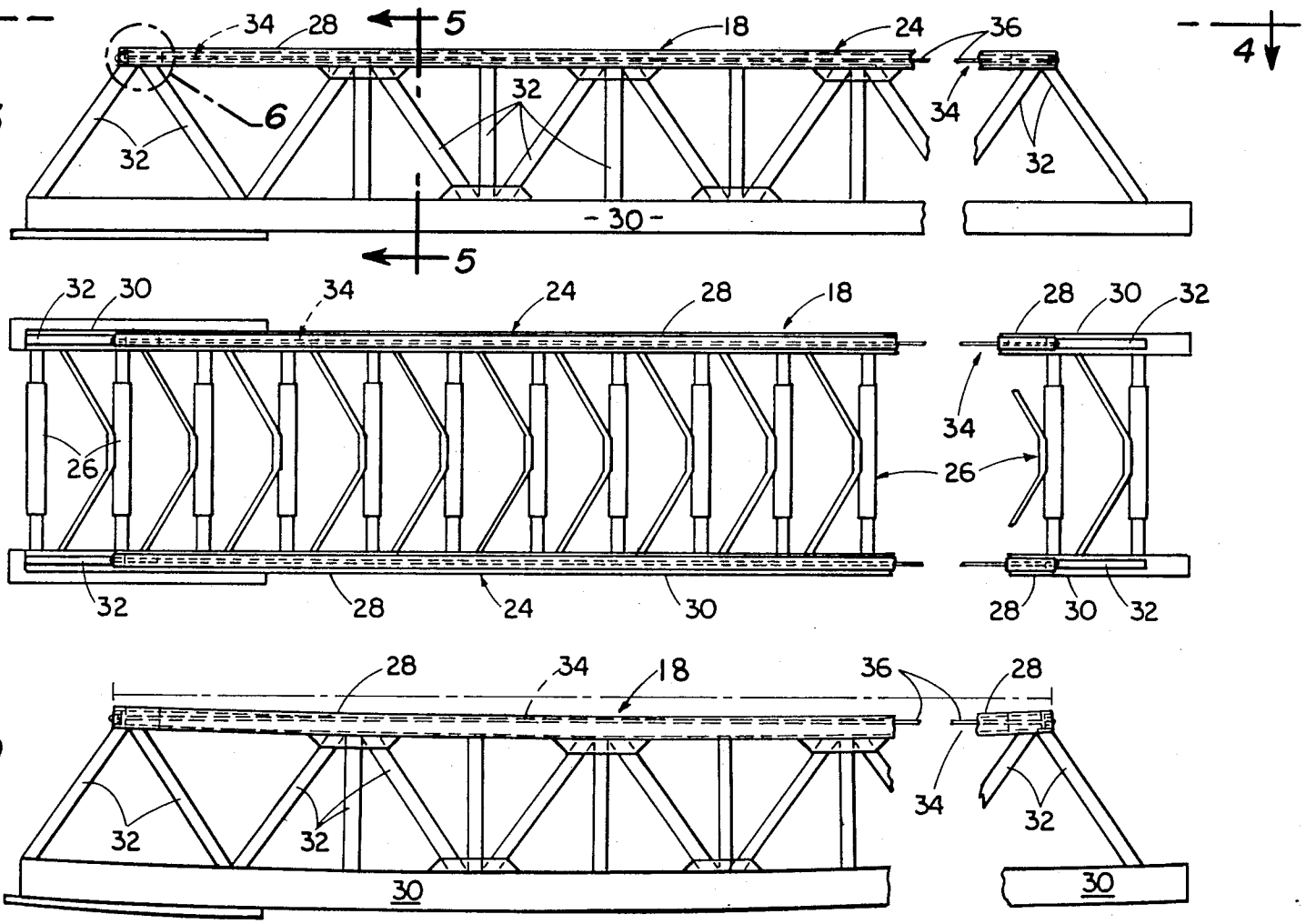
FIG. 3 is an enlarged side elevational view of a middle one of the multiple sections of the ladder tower of FIG. 1 with the middle section being shown alone.
FIG. 4 is a top plan view of the middle ladder tower section as seen along line 4—4 of FIG. 3.
FIG. 9 is a side elevational view of the middle ladder tower section similar to that of FIG. 3, showing in exaggerated form the deflection of the ladder tower section resulting from application of the pretensioning structure thereto.

In accordance with the principles of the present invention, each ladder tower section 18, such as the middle one being illustrated in FIGS. 3-5, is preferably composed of two longitudinally extending, laterally spaced apart truss members, generally designated 24, interconnected by a plurality of longitudinally spaced ladder rungs 26. The innermost telescopible one of the sections 16 at its free distal end mounts the working platform 22 as done heretofore (see FIG. 10).

Each truss member 24 is constructed of an upper, hollow, elongated hand rail 28 and a lower, hollow, elongated rung rail 30 which is spaced below and lies in a generally vertical plane with the upper hand rail 28, as best seen in FIG. 5. The upper hand rail 28 and lower rung rail 30 are interconnected to one another by reinforcing members in the form of a series of vertically and angularly extending braces 32. The ladder rungs 26 extend between and interconnect the rung rails 30 of the respective pair of laterally spaced truss members 24.

Figure 6:
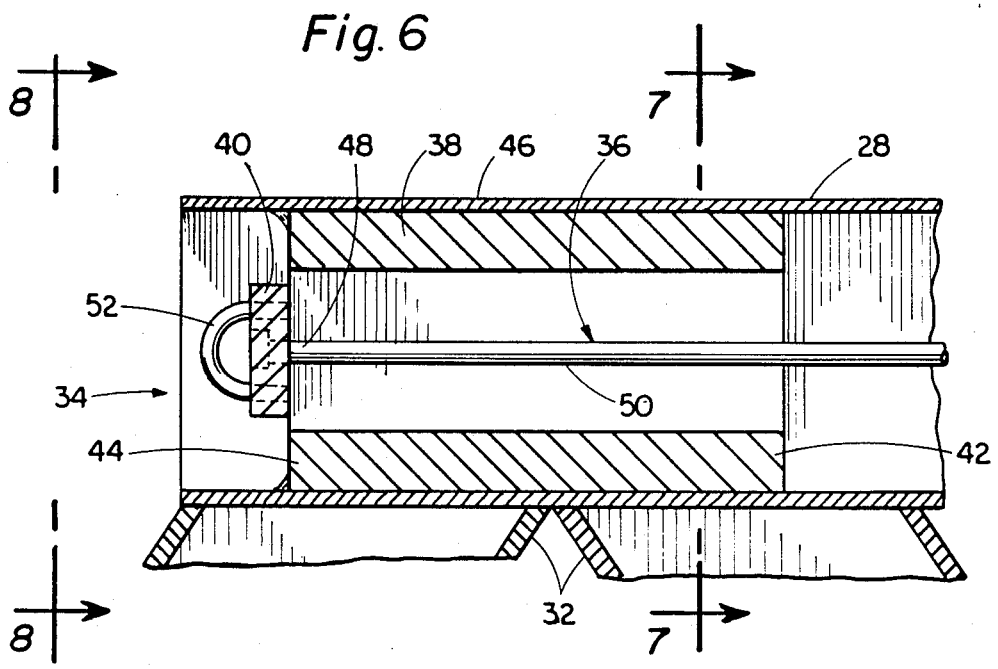
FIG. 6 is an enlarged longitudinal sectional view of an end portion of one of the truss member hand rails of the ladder tower section encompassed by a circle 6 in FIG. 3, showing the pretensioning structure associated with the hand rail.
Figure 7:
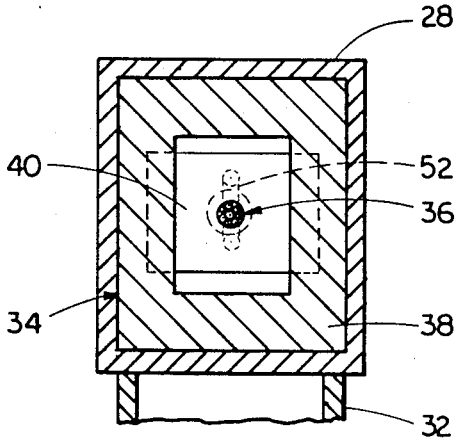
FIG. 7 is a cross-sectional view of the truss member hand rail taken along line 7—7 of FIG. 6.
Figure 8:
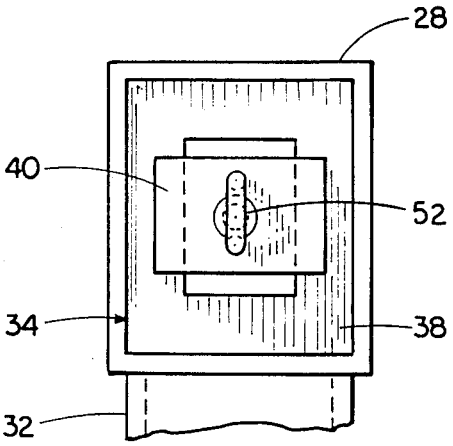
FIG. 8 is an end view of the truss member hand rail as seen along line 8—8 of FIG. 6.

Turning now to FIGS. 6–8, for substantially reducing the degree of dead load-induced deflection of the ladder tower sections 18, preload means in the form of a pretensioning structure, generally designated 34, is provided in association with each truss member 24. Specifically, the pretensioning structure 34 is primarily composed of a pretensioned flexible member 36, such as a conventional flexible metal cable, attached to and extending through each of the hollow hand rails 28 of the truss members 24 so as to preload the hand rails in compression and thereby preload the rung rails 30 in tension. With such arrangement and predetermined amount of pretensioning, the dead load of each respective ladder tower section 18 being due primarily to its own weight is substantially offset and the live load capacity of each section 18 is substantially increased. Parenthetically, it should be mentioned at this point that an example will be explained below to facilitate understanding of these achievements.

More particularly, the pretensioning structure 34 attached to each truss member hand rail 28, in addition to the flexible metal cable 36 disposed in the hollow hand rail 28 and anchored at its opposite ends to the hand rail, also includes a hollow tube or sleeve 38 and a connector 40. The metal anchor sleeve 38 has inner and outer or abutting opposite ends 42,44 and is disposed within each opposite end portion 46 of the hollow hand rail 28 at locations within and spaced from its opposite ends. Preferably, the sleeve 38 is rectangular in cross-section as is the hand rail 28 and greater in height than in width.

The connectors 40, in the embodiment best shown in FIGS. 6–8, are in the form of flat rectangular metal plates on the opposite ends 48 of the cable 36. Since each of the connectors 40 are identical, only the left one need be described. The connector 40 is coupled on the cable end 48 and is longer than the width of interior of the sleeve 38. The connector 40 is positioned outside of the sleeve 38 so as to overlap its outer end 44. The connector 40 is rigidly affixed, such as by welding, to the outer end 44 of the hollow sleeve 38 with each opposite end portion 50 of the cable 36 extending through the interior of the sleeve. The pretensioned cable 36 further has an eye or hook element 52 defined on each of its opposite ends 48. Each hook element 52 is disposed outwardly of the connector 40 and is useful in applying opposing forces to the cable 36 for pretensioning it during installation of the same within the hollow hand rail 28. Once the cable 36 is tensioned the desired amount, the sleeves 38 are then suitably fastened, such as by welding, to the hand rails 28 and the connectors 40 welded to the sleeves.

FIGS. 11 and 12 show an alternative embodiment for anchoring the ends 50 of the cable 36 within the opposite ends 46 of the hollow hand rails 28. In this embodiment, the sleeve 38 is rigidly affixed, such as by welding, within the end portion 46 of the hollow hand rail 28. A connector 40', being in the form of a flat metal plate and having a central bore 41 defined therein, is positioned adjacent the outer end 44 of the sleeve 38 and is dimensioned so as to overlap the outer end 44. A threaded eye-bolt 47 extends through the bore 41 of the connector plate 40' for threadable connection with a fastening nut 49 which bears against the outer side of the connector plate 40', as best seen in FIG. 11. The opposite end of the bolt 47 contains an eye 51 through which the end 50 of the cable 36 is looped through and doubled back upon itself and clamped in such securing position by a suitable clamp 53 whereby the eye-bolt 47 is attached to the cable end 50. With such arrangement, pretensioning of the cable 36 within the hollow hand rail 28 is now accomplished by tightening of the fastener nut 49 on the threaded end of the eye-bolt 47.

FIG. 9 shows in exaggerated form the deflection of the middle ladder tower section 18 of the ladder tower 14 resulting from application of the pretensioning structure 34 thereto. FIG. 10 shows the effect of the pretensioning structure 34 after application to each of the sections 18 of the ladder tower 14 when the ladder tower is placed in its extended position. As shown, the dead load of the sections 18 are substantially offset by the pretensioning structures 34 such that now there is substantially little, if any, deflection of the ladder tower 14 due to its total dead load.

Examples explaining and contrasting the stresses and loads imposed on a ladder tower section 18 before and after incorporation of the pretensioning structure 34 now follow.

As has been mentioned, a ladder tower section under its own weight and vertical payload (such as a person) deflects in a cantilevered fashion. Without the benefit of the pretensioning structure, this deflection results in a normal stress distribution in which the hand rails are in tension and the rung rails are in compression. By way of example, for a prior art ladder tower section, suppose:

(1) stress due to dead load ($DL_S$) for:
  (a) hand rail: +15 ksi (tension)
  (b) rung rail: −10 ksi (compression);
(2) stress due to live load of 800 lbs. ($LL_S$) for:
  (a) hand rail: +10 ksi (tension)
  (b) rung rail: −8 ksi (compression)

then, using the combined stress criteria: $DL_S + (LL_S \times 3) \leqq F_Y$, where $F_y$ is the material yield strength which for the hand rail is $F_{YHR} = 45$ ksi and for the rung rail is $F_{YRR} = 50$ ksi, (3) the combined stress for:
  (a) hand rail: +15 +(3)(+10) = +45 ksi
  (b) rung rail: -10 +(3)(-8) = -34 ksi.

It is seen that for the prior art ladder tower section in the above example, a live load of 800 lbs. places the hand rail at its material yield strength limit.

However, in order to increase the ladder tower section's capacities and reduce deflections, in accordance with the principles of the present invention the hand rails of the section are preloaded with the pretensioning structure wherein the cable is prestretched to a known value and anchored at each end of the respective hand rails. This induces a reversed stress in the section relative to that experienced from the normal vertical loads. The hand rails are now loaded in compression and the rung rails in tension. It also produces a reversed curvature (deflection) in the section such that the section can now achieve greater capacities because the section will be able to achieve higher stress increases due to the live load. By way of example, for a pretensioned ladder tower section, suppose:

(1) stress due to dead load ($DL_S$) for hand load rung rail are the same as above;

(2) stress due to live load of 800 lbs. ($LL_S$) for hand rail and rung rail are the same as above; and (3) stress due to preload ($PL_S$) for:

(a) hand rail: −8 ksi (compression)

(b) rung rail: +5 ksi (tension)

then, using the combined stress criteria: $DL_S + PL_S + (LL_S \times 3) \leqq F_Y$, where $F_Y$ is the material yield strength which for the hand rail and the rung rail are the same as above, (4) the combined stress for:

(a) hand rail: $+15 + (-8) + (3)(+10) = +37$ ksi (b) rung rail: $-10 + 5 + (3)(-8) = -29$ ksi.

Since the stresses for both the hand rail and rung rail are reduced when compared to those earlier, the capacity of the section can be increased (i.e., increasing its live load stress). Since stress is linear, if 800 lbs. produces 10 ksi, then 1000 lbs produces 12.5 ksi. A live load of 1000 lbs., or stress of 12.5 ksi, would result in a combined stress of 44.5 ksi for the hand rail which approaches close to its material yield strength limit. The increased combined stress for the rung rail would not reach its material yield strength limit. The live load capacity of the ladder tower section is thus increased from 800 lbs. to 1000 lbs. by employing the pretensioning structure in its hand rails.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred or exemplary embodiment thereof.

I claim:

1. In a ladder tower section having a pair of longitudinally extending, laterally spaced apart truss members and a plurality of longitudinally spaced ladder rungs interconnecting said truss members, each of said truss members including an upper hand rail, a lower rung rail being spaced below said upper hand rail, and reinforcing means extending between and interconnecting said upper hand rail and lower rung rail, said ladder rungs extending between and interconnecting said rung rails of said respective truss members, the improvement which comprises:

means attached to each of said truss members so as to preload said hand rail thereof in compression and said rung rail thereof in tension such that an increase in the live load capacity of said section is achieved.

2. The ladder tower section as recited in claim 1, wherein said preload means being attached to said each truss member is connected to said hand rail thereof so as to load said hand rail in compression and load said rung rail thereof in tension and thereby substantially offset the dead load of said section due to its weight.

3. The ladder tower section as recited in claim 1, wherein said preload means being attached to said each truss member includes a pretensioned cable connected to said hand rail thereof.

4. The ladder tower section as recited in claim 1, wherein:

said hand rail of said each truss member is hollow; and said preload means being attached to said each truss member includes a pretensioned flexible member disposed in said hollow hand rail of said each truss member and anchored at its opposite ends to said hollow hand rail at locations within and spaced from opposite ends thereof.

5. The ladder tower section as recited in claim 4, wherein said preload means being attached to said each truss member also includes:

a hollow sleeve having inner and outer opposite ends and being disposed and rigidly affixed within each opposite end of said hollow hand rail at said locations therein; and a connector coupled on each opposite end of said pretensioned flexible member and positioned outside of and rigidly affixed to said outer end of said each hollow sleeve with each opposite end portion of said flexible member extending through said each sleeve.

6. The ladder tower section as recited in claim 5, wherein said pretensioned flexible member has an element defined on each opposite end thereof being disposed outwardly of said connector, said element being useful in pretensioning said flexible member during deployment of the same within said hollow hand rail.

7. The ladder tower section as recited in claim 4, wherein said preload means being attached to said each truss member also includes:

a hollow sleeve having inner and outer opposite ends and being disposed and rigidly affixed within each opposite end of said hollow hand rail at said locations therein;

a connector having a bore defined therethrough and being disposed adjacent the outer end of said each hollow sleeve;

an eye-bolt clamped to each opposite end of said pretensioned flexible member and extending through said bore of said connector; and a nut fastened on the opposite end of said eye-bolt and positioned adjacent an outer side of said connector for preloading said flexible member within said hollow hand rail.

8. In a ladder tower having multiple telescoping sections wherein each section includes a pair of longitudinally extending, laterally spaced apart truss members and a plurality of longitudinally spaced ladder rungs interconnecting said truss members, each of said truss members of each of said sections comprising in combination:

(a) an upper elongated hand rail;

(b) a lower elongated rung rail being spaced below said upper hand rail, said ladder rungs of each section extending between and interconnecting said rung rails of said truss members thereof;

(c) a plurality of braces extending between and interconnecting said upper hand rail and lower rung rail of said each truss member; and (d) pretensioning means connected to said hand rail of said each truss member so as to load said hand rail thereof in compression and said rung rail thereof in tension and thereby substantially offset the dead load of said each section due to its weight and permit an increase in the live load capacity of said each section.

9. The ladder tower as recited in claim 8, wherein said pretensioning means being connected to said hand rail of said each truss member includes a pretensioned cable.

10. The ladder tower as recited in claim 8, wherein:

said hand rail of said each truss member is hollow; and said pretensioning means being connected to said hand rail of said each truss member includes a pretensioned flexible member disposed in said hollow hand rail of said each truss member and anchored at its opposite ends to said hollow hand rail at locations within and spaced from opposite ends thereof.

11. The ladder tower as recited in claim 10, wherein said pretensioning means being attached to each truss member also includes:

a hollow sleeve having inner and outer opposite ends and being disposed and rigidly affixed within each opposite end of said hollow hand rail at said locations therein; and a connector coupled on each opposite end of said pretensioned flexible member and positioned outside of and rigidly affixed to said outer end of said each hollow sleeve with each opposite end portion of said flexible member extending through said each sleeve.

12. The ladder tower section as recited in claim 11, wherein said pretensioned flexible member has an element defined on each opposite end thereof being disposed outwardly of said connector, said element being useful in pretensioning said flexible member during installation of the same within said hollow hand rail.

13. The ladder tower as recited in claim 10, wherein said preload means being attached to said each truss member also includes:

a hollow sleeve having inner and outer opposite ends and being disposed and rigidly affixed within each opposite end of said hollow hand rail at said locations therein;

a connector having a bore defined therethrough and being disposed adjacent the outer end of said each hollow sleeve;

an eye-bolt clamped to each opposite end of said pretensioned flexible member and extending through said bore of said connector; and a nut fastened on the opposite end of said eye-bolt and positioned adjacent an outer side of said connector for preloading said flexible member within said hollow hand rail.

* * * * *